US012075815B2

(12) United States Patent
Esposti et al.

(10) Patent No.: US 12,075,815 B2
(45) Date of Patent: Sep. 3, 2024

(54) MACHINE AND METHOD FOR MAKING A SUB-UNIT OF A SMOKING ARTICLE

(71) Applicant: G.D S.P.A., Bologna (IT)

(72) Inventors: Marco Esposti, Bologna (IT); Nicola Baldanza, Bologna (IT); Ivan Eusepi, Bologna (IT); Gabriele Benni, Bologna (IT); Giuliano Gamberini, Bologna (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 193 days.

(21) Appl. No.: 17/615,350

(22) PCT Filed: May 27, 2020

(86) PCT No.: PCT/IB2020/055004

§ 371 (c)(1),
(2) Date: Nov. 30, 2021

(87) PCT Pub. No.: WO2020/240423

PCT Pub. Date: Dec. 3, 2020

(65) Prior Publication Data

US 2022/0218018 A1 Jul. 14, 2022

(30) Foreign Application Priority Data

May 31, 2019 (IT) ..... 102019000007680
May 31, 2019 (IT) ..... 102019000007689

(51) Int. Cl.
*A24C 5/00* (2020.01)
*A24C 5/01* (2020.01)
(Continued)

(52) U.S. Cl.
CPC ..... *A24C 5/54* (2013.01); *A24C 5/007* (2013.01); *A24C 5/01* (2020.01); *A24C 5/1885* (2013.01); *A24C 5/46* (2013.01)

(58) Field of Classification Search
None
See application file for complete search history.

(56) References Cited

U.S. PATENT DOCUMENTS 4,625,498 A * 12/1986 Parsons ..... B65B 7/28 53/526
2018/0303159 A1 10/2018 Ghiotti et al.

FOREIGN PATENT DOCUMENTS

EP 2091361 B1 * 5/2008 ..... A24D 1/00
EP 2091361 A1 8/2009
WO 2009007258 A1 1/2009

OTHER PUBLICATIONS

International Search Report and Written Opinion dated Oct. 2, 2020 from counterpart International Patent Application No. PCT/IB2020/055004.

* cited by examiner

*Primary Examiner* — Christopher M Rodd
*Assistant Examiner* — Daniel Edward Vakili
(74) *Attorney, Agent, or Firm* — SHUTTLEWORTH & INGERSOLL, PLC; Timothy J. Klima

(57) ABSTRACT

A machine for making sub-units of smoking articles includes a conveyor, a feed unit and an applicator. The conveyor conveys a succession of tubular segments transversely along a conveying direction. The feed unit feeds and conveys a continuous web and advances the web along a feed direction parallel to the conveying direction of the tubular segments so that the web faces respective application ends of the tubular segments. The applicator is movable along an application direction parallel to an axis of predominant extension of the succession of tubular segments and is configured to engage the web so as to separate respective closing elements from it. The applicator is also configured to apply the closing element internally or externally on an application end of a (Continued)

respective tubular segment in such a way as to form a closing wall to at least partly close the application end.

9 Claims, 4 Drawing Sheets

(51) Int. Cl.

| | |
|---|---|
| ***A24C 5/18*** | (2006.01) |
| ***A24C 5/46*** | (2006.01) |
| ***A24C 5/54*** | (2006.01) |

MACHINE AND METHOD FOR MAKING A SUB-UNIT OF A SMOKING ARTICLE

This application is the National Phase of International Application PCT/IB2020/055004 filed May 27, 2020 which designated the U.S.

This application claims priority to Italian Patent Application No. 102019000007689 filed May 31, 2019 and Italian Patent Application No. 102019000007680 filed May 31, 2019, which applications are incorporated by reference herein.

TECHNICAL FIELD

This invention addresses the technical field of the production of articles of the tobacco industry.

More specifically, the invention relates to a machine and a method for making a sub-unit of a smoking article which may be, for example, of the type configured to generate an aerosol by heating, preferably without burning, or an electronic cigarette.

This invention also relates to a smoking article and to the method for making the smoking article.

BACKGROUND ART

In this context, in order to be able to ensure the quality of the finished product, it is very important to ensure that the active material—that is, the material that generates the aerosol—is correctly contained and retained both during the production process and during use of the article.

Prior art production methods involve making a smoking article composed of a rod-shaped body (for example a filter or a heating element) and a tube made of wrapping material which is then filled with the aerosol-generating element.

This solution, however, is not very suitable for guaranteeing the integrity of the article, in particular because it does not guarantee correctly retaining the aerosol generating element—that is, the active portion of the smoking article—in the tubular segment when the smoker inhales.

That means that during use of the smoking article, the aerosol generating element could come out of its sub-unit and find its way into the adjacent ones, thus negatively affecting the operation of the product.

Indeed, the effect of the smoker puffing at the smoking article could have the undesirable result of causing the aerosol generating element or any of the other materials making up the smoking article to come out of the sub-unit.

Aim of the Invention

In this context, the technical purpose which forms the basis of this invention is to propose a machine and a method or making a sub-unit of a smoking article to overcome at least some of the above-mentioned disadvantages of the prior art.

In particular, the aim of this invention is to provide a machine and a method for making a sub-unit of a smoking article capable of optimizing the production process while at the same time improving the quality and stability of the end product that can be made using it.

The technical purpose indicated and the aims specified are substantially achieved by a machine and a method for making a sub-unit of a smoking article comprising the technical features described in one or more of the accompanying claims.

This invention discloses a machine for making sub-units of smoking articles and comprising a conveyor, a feed unit and at least one applicator.

The conveyor is configured to convey a succession of tubular segments of the tobacco industry transversely along a conveying direction.

The feed unit is configured to feed and convey a continuous web and to advance the continuous web along a feed direction parallel to the conveying direction of the tubular segments so that the continuous web faces respective application ends of the tubular segments.

The at least one applicator is movable along an application direction parallel to an axis of predominant extension of each tubular segment of the succession of tubular segments and is configured to engage the continuous web so as to separate respective closing elements from it.

The at least one applicator is also configured to apply the closing element internally or externally on an application end of a respective tubular segment in such a way as to form a closing wall to at least partly close the application end.

In an embodiment, the at least one applicator is configured to apply the closing element externally on the application end of a respective tubular segment, preferably by gluing, in such a way as to form a closing wall which at least partly closes the application end and in particular, which is disposed at least partly, preferably entirely, on the outside of the application end.

In an embodiment, the at least one applicator is configured to apply the closing element internally on the application end of a respective tubular segment, that is to say, to insert the closing element into the application end in such a way as to form a closing wall which at least partly closes the application end and in particular, which is disposed at least partly, preferably entirely, on the inside of the application end.

Preferably, the at least one movable applicator is configured to separate from the continuous web closing elements whose size is such as to partly cover the application end.

Alternatively, the at least one movable applicator is configured to separate from the continuous web closing elements whose size is such as to completely cover the application end.

Advantageously, the machine described here allows applying closing elements to the tubular segments in such a way as to make sub-units having suitable closing walls at least at one end of them.

This feature prevents material from accidentally passing through the reclosed end of the segment itself.

Also an object of this invention is a method for making a sub-unit of smoking article, comprising the following steps:

- preparing a tubular segment of the tobacco industry, internally provided with a through duct that terminates with end openings of the tubular segment;
- applying a closing element externally or internally on an application end of the tubular segment in such a way as to form a closing wall to at least partly close the application end.

More specifically, the step of applying is performed by an applicator moving with translational to-and-fro motion along an application direction parallel to the axis of predominant extension of each tubular segment of the succession of tubular segments.

In an embodiment, the step of applying is accomplished by applying the closing element externally on the application end of a respective tubular segment, preferably by gluing, in such a way as to form a closing wall which at least partly closes the application end and in particular, which is disposed at least partly, preferably entirely, on the outside of the application end.

In an embodiment, the step of applying is accomplished by applying the closing element internally on the application end of a respective tubular segment, that is to say, by inserting the closing element into the application end in such a way as to form a closing wall which at least partly closes the application end and in particular, which is disposed at least partly, preferably entirely, on the inside of the application end.

Advantageously, the method proposed herein provides a quick and efficient way of applying a closing wall on a tubular segment so as to make a sub-unit that is capable of ensuring that the filling material will be correctly held within it, inside the smoking article into which the sub-unit will be inserted.

Also an object of this invention is a smoking article which comprises an aerosol generating segment, a filter segment and at least one spacing tube interposed between the two segments.

More specifically, the spacer tube has an end that is at least partly closed with a closing element applied internally or externally on an application end of it, thereby at least partly closing the application end, so that the closing element is interposed between the spacer tube and one between the aerosol generating segment and the filter segment.

In an embodiment, the closing element is applied externally on the application end of a respective tubular segment, in such a way as to form a closing wall which at least partly closes the application end and in particular, which is disposed at least partly, preferably entirely, on the outside of the application end.

In a different embodiment, the closing element is applied internally on the application end of a respective tubular segment, that is to say, it is inserted into the application end in such a way as to form a closing wall which at least partly closes the application end and in particular, which is disposed at least partly, preferably entirely, on the inside of the application end.

In the second embodiment, the closing element is shaped or deformed in such a way as to define a convex surface facing towards the aerosol generating segment.

According to an aspect of this invention, the closing element has at least one edge portion and is coupled to the tubular segment by an interference fit between the edge portion and an inside wall of the application end.

Alternatively, the closing element has at least one edge portion and is coupled to the tubular segment by gluing the edge portion to an inside wall of the application end.

Preferably, the spacer tube is abutted directly against the aerosol generating segment and/or against the filter segment.

Preferably, the smoking article comprises an additional segment, specifically a cooling segment, preferably tubular.

More specifically, the additional segment is interposed between the spacer tube and the aerosol generating segment or between the spacer tube and the filter segment.

Preferably, the spacer tube is abutted directly against the additional segment, so that the closing element is interposed directly between the spacer tube and the additional segment.

Preferably, the closing element is made of porous material and/or has a plurality of holes or perforations for increasing the air or gas permeability of the closing wall.

Preferably, the closing element is made of metallic material and, still more preferably, the closing element is made of aluminium.

Preferably, the closing element is made of a flame retardant material.

Advantageously, the special structural configuration of the smoking article, thanks to the presence of the closing wall interposed and/or operating between adjacent segments, ensures that the filling material is held within correctly, preventing its migration between adjacent segments inside the smoking article and preferably is also prevented from falling out.

Also an object of this invention is a method for making a smoking article, comprising the following steps:

- preparing a filter segment;
- preparing an aerosol generating segment;
- preparing a spacer tube having an end that is at least partly closed with a closing element applied internally or externally on an application end of it, thereby at least partly closing the application end;
- aligning the filter segment, the aerosol generating segment and the spacer tube with each other along a direction of predominant extension in such a way that the closing element is interposed between the spacer tube and one between the aerosol generating segment and the filter segment.

Preferably, the method further comprises the following steps:

- preparing an additional segment, specifically a cooling segment, preferably tubular;
- interposing the additional segment between the spacer tube and one between the aerosol generating segment and the filter segment, placing the spacer tube in direct abutment against the additional segment, so that the closing element is interposed directly between the two.

Advantageously, the method described herein allows making a smoking article having a closing wall that prevents the filling material of the smoking article from passing from one portion of it to another.

The dependent claims, which are incorporated herein by reference, correspond to different embodiments of the invention.

BRIEF DESCRIPTION OF THE DRAWINGS

Further features and advantages of this invention are more apparent in the following indicative, hence non-limiting, description of a preferred, but non-exclusive embodiment of a machine and a method for making a sub-unit of a smoking article, as illustrated in the accompanying drawings in which.

DETAILED DESCRIPTION OF PREFERRED EMBODIMENTS OF THE INVENTION

Figure 1:
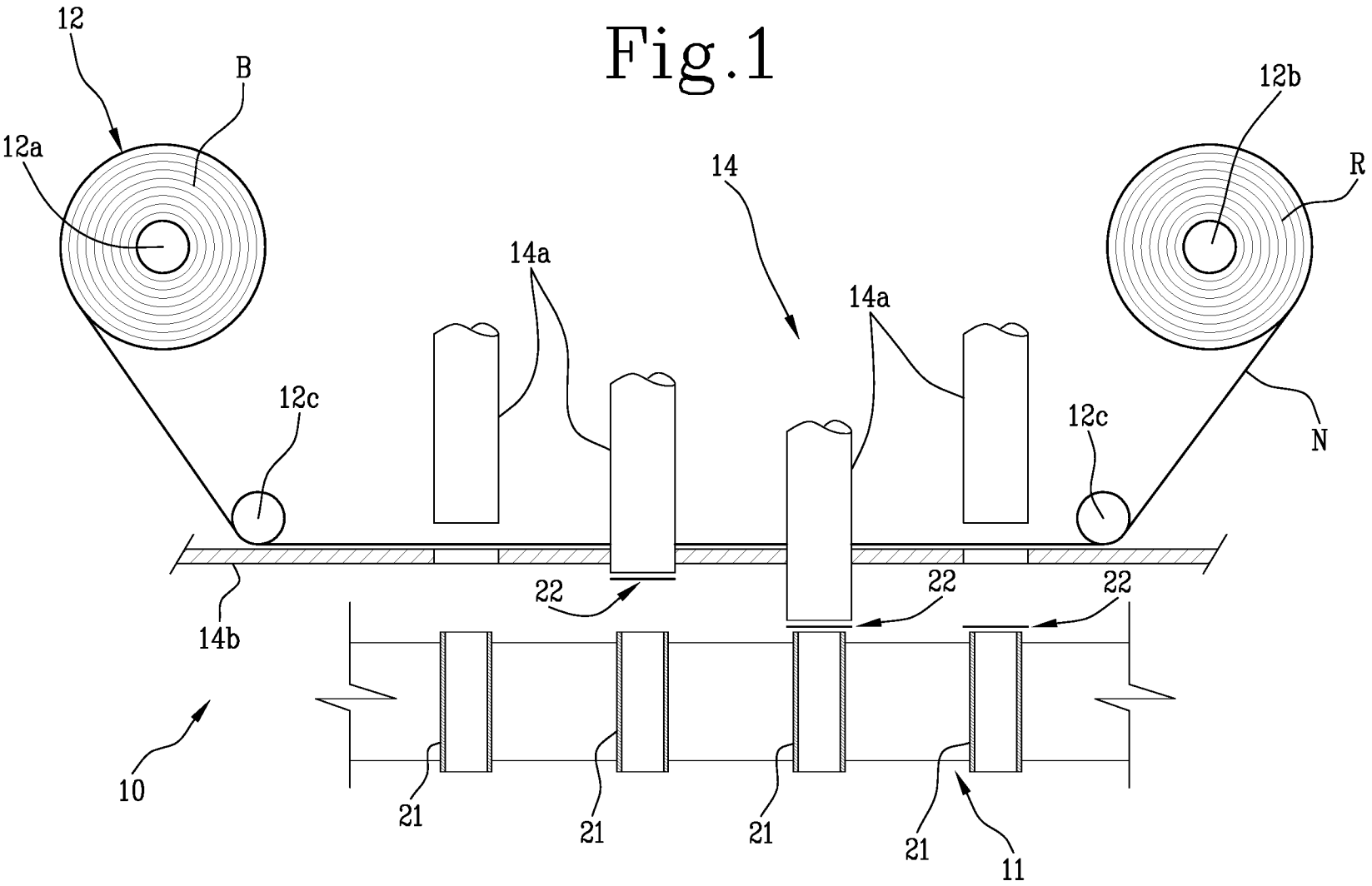
FIG. 1 schematically illustrates the main components of a machine according to a first embodiment of this invention.
Figure 4:
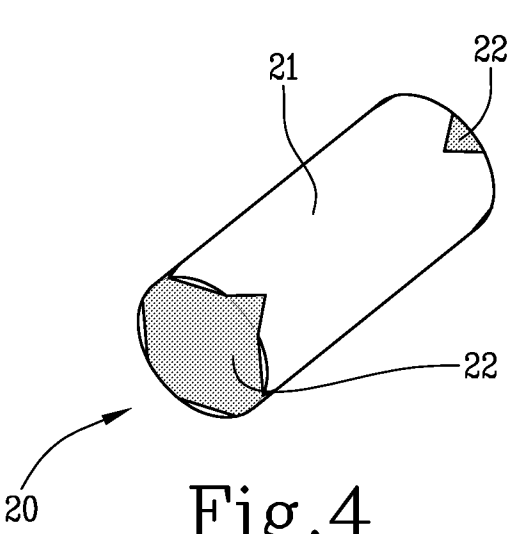
FIGS. 3 and 4 show the sub-units made by the machine of FIG. 1.
Figure 3:
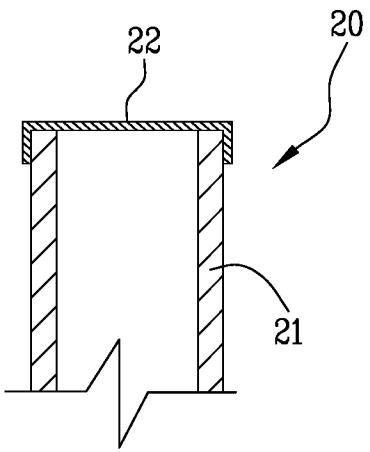
Figure 2:
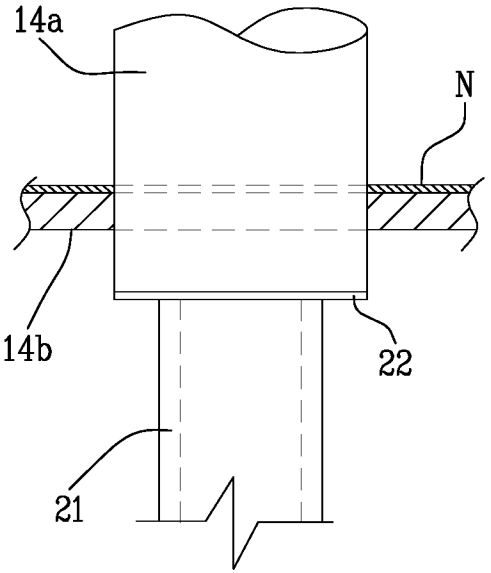
FIG. 2 shows in detail how a closing element is applied on the respective tubular segment by the machine of FIG. 1.

The reference numeral 10 in FIGS. 1-5 denotes a machine for making sub-units 20 of smoking articles according to a first embodiment of this invention.

The machine 10 comprises a conveyor 11, a feed unit 12 and at least one applicator 14.

The conveyor 11 is configured to feed a succession of tubular segments of the tobacco industry.

More specifically, the conveyor 11 may be a conveyor drum, a conveyor belt or any other conveying device provided with suitable seats adapted to hold the tubular segments.

More specifically, each tubular segment 21 is internally provided with a through duct that terminates with openings at opposite ends of the tubular segment 21.

In other words, the interior of the tubular segment 21 defines a duct, which also acts as a containment chamber for containing a filling material of the tobacco industry and which terminates in the open ends of the tubular segment 21 itself.

By way of a non-limiting example, the through duct can therefore contain a filling material such as an aerosol-generating material, tobacco pellets, tobacco which is loose or in another form, flavouring material (for example microcapsules containing a flavouring liquid) or a filtering material (activated charcoal, silica gel or others known in the reference sector) or even a material with cooling effect (such as PLA pellets).

The feed unit 12 is configured to feed the continuous web N along a feed direction parallel to the conveying direction of the tubular segments 21 so that the continuous web N faces respective application ends of the tubular segments 21.

More specifically, the feed unit 12 comprises a first support 12*a* configured to support and unwind a roll B of continuous web N and a second support 12*b* configured to support and wind up a winding-up roll R round which the continuous web N can be wound.

In other words, the feed unit comprises suitable supports 12*a*, 12*b* which allow unwinding the continuous web N and feeding it to those parts of the machine 10 responsible for processing it and then collecting the portion of the continuous web N left unused by the processes and thus constituting waste that can be suitably disposed of or recycled.

The feed unit 12 also comprises guide means 12*c*—for example, fixed or movable rollers, either power-driven or idle—interposed between the first support 12*a* and the second support 12*b* and configured to convey and support the continuous web N along the feed direction, which is preferably rectilinear.

The applicator 14 is movable along an application direction parallel to an axis of predominant extension of each tubular segment 21 of the succession of tubular segments 21 and is configured to engage the continuous web N so as to separate at least one closing element 22 from it.

The applicator 14 is also configured to apply the closing element 22, which it has separated from the continuous web N, on an application end of a respective tubular segment 21 in such a way as to form a closing wall to at least partly close the application end.

Further, the applicator 14 is movable along the conveying direction synchronously with the conveyor 11.

That is to say that the at least one applicator 14 moves as one with the conveyor 11 so as to remain facing a specific retaining seat of the conveyor, which is configured to receive and hold a tubular segment 21.

Preferably, the synchronous movement is obtained by mounting the at least one applicator 14 on the conveyor 11 or on a different movement means advancing at the same speed as the conveyor 11.

Still more preferably, the machine 10 comprises a plurality of applicators 14, disposed in succession along the conveying direction and movable synchronously with the conveyor 11 along the conveying direction either because they are mounted on it or because they are provided with suitable movement means that allow the synchronized movement with the conveyor 11.

More specifically, the conveyor 11 and the at least one applicator 14 are movable along respective closed-loop trajectories running side by side.

Preferably, the closed-loop trajectories have a pair of substantially rectilinear stretches parallel to the conveying direction.

In this context, the tubular segments 21 are conveyed along at least one of the rectilinear stretches.

In a preferred embodiment, the at least one applicator 14 is configured to separate from the continuous web N a succession of closing elements 22 having a circular or other shape.

Preferably, the at least one applicator 14 is configured to separate closing elements 22 whose diameter is greater than or equal to the inside diameter of the tubular segments 21 on which they are going to be applied. In this case, as discussed in more detail below, the closing element 22 covers the application end completely.

More in detail, the applicator 14 comprises a punch 14*a* and a punch plate 14*b*.

The punch 14*a* is configured to engage the continuous web N so as to separate respective closing elements 22 from it.

The punch plate 14*b*, on the other hand, is provided with a through hole that is shaped to match the punch 14*a* in such a way that the punch 14*a* can be inserted snugly into it.

The continuous web N is made to advance between the punch 14*a* and the punch plate 14*b* so that the punch sequentially engages first the continuous web N and, only after that, the hole in the punch plate 14*b*, so as to promote detachment of the closing element 22 from the continuous web N.

More in detail, the applicator 14 comprises a drive rod on which the punch 14*a* is applied and which is slidably inserted in a respective linear guide and engaged with a fixed cam.

That way, as the applicator 14 advances along the conveying direction, the interaction between the drive rod and the fixed cam causes a to-and-fro translational movement of the drive rod along the application direction.

The closing wall provides a barrier which prevents any filling material of the smoking article 30 into which the sub-unit 20 will be placed from passing through the application end of the tubular segment 21.

At the same time, the closing wall must be such as to allow the passage of air and/or gas and/or aerosol through the end of the sub-unit 20, in particular in the direction of a smoker during use of the smoking article 30 into which the sub-unit 20 has been inserted.

In a first possible embodiment, the closing element 22 has an overall size such as to completely cover the application end.

Alternatively, the closing element 22 has an overall size such as to only partly cover the application end.

If the closing wall completely covers the application end of the tubular segment 21, the closing element 22 is made of a porous material and/or has a plurality of holes or perforations for increasing the air or gas permeability of the closing wall in order to ensure a correct flow of air and/or gas and/or aerosol through the sub-unit 20.

In other words, if the closing wall is such as to completely close off access to the duct defined by the interior of the tubular segment 21, the closing element is made in such a way that air and/or gas and/or aerosol can in any case pass through because it is made of porous material and/or because it is provided with suitable openings.

For this purpose, the machine 10 comprises perforating means which operate specifically on the continuous web N to make holes or perforations configured to allow air or gas to pass through.

Preferably, the perforating means comprise at least one laser.

On the other hand, in the case where the closing wall is such as to only partly cover the application end of the tubular segment 21, the correct flow of air and/or gas and/or aerosol through the sub-unit 20 is guaranteed by those portions of the application end that remain uncovered and thus, the closing element 22 may also be made of a material that is impermeable to air.

It is, however, also possible for the closing element 22 to be made of porous material and or to be provided with a plurality of holes or perforations to increase the air or gas permeability of the closing wall even if the closing element 22 only partly closes the application end.

More specifically, the closing element 22 may be made of metallic material: for example, aluminium.

Preferably, the closing element 22 is made of flame retardant material.

Generally, the machine 10 further comprises folding means, located downstream of the at least one applicator 14 and configured to fold against an external surface of the tubular segment 21 portions of the respective closing element 22 protruding beyond an external profile of the application end.

The folding means, whose structure is described in more detail below, thus allow the closing element 22 to adhere better to the tubular segment 21, by increasing the mutual contact surface.

The folding means also allow improving the structural integrity of the sub-unit 20 by removing any protruding portions of the closing element 22 which might impact other portions of semi-products or processing devices during the possible further processes which the sub-unit 20 might be subjected to.

In a first possible embodiment, the folding means are movable along a direction perpendicular to the application end of the tubular segments 21 so as to engage the closing element from the front.

Alternatively, in a different possible embodiment, the folding means are fixed and the machine 10 comprises movement means configured to move each tubular segment 21 axially in such a way as to engage the folding means after the closing element 22 has been applied on the application end.

Preferably, coupling the closing element 22 to the respective tubular segment 21 is done by gluing.

For this purpose, the machine 10 comprises a gumming device for applying an adhesive substance on the application end of the tubular segment 21 and/or on the closing element 22.

In other words, the gumming device is operatively associated either with the conveyor 11 or with the feed unit 12 to apply, either on the application end or on the continuous web N, respectively, an adhesive substance that will subsequently allow the closing element 22 and the tubular segment 21 to be glued to each other at the application end.

Preferably, the gumming device is configured to apply the adhesive substance solely on the portion of the closing element 22 or of the tubular segment 21 that is intended to come into contact with the application end or with the closing element 22, respectively.

In other words, the adhesive layer is applied according to a pattern that follows the profile of the closing element 22 that is superposed on the application end of the tubular segment 21 and leaves free the part of the closing element 22 that directly faces the duct defined by the tubular segment 21.

The machine 10 further comprises detecting means configured to check the position of the closing element 22 relative to the application end.

By way of non-limiting example, the detecting means may comprise optical sensors, such as cameras, or acoustic sensors, such as ultrasound sensors.

The machine 10 also comprises a pair of feed units 12 configured for feeding respective continuous webs N along feed directions parallel to the conveying direction of the tubular segments 21 and in such a way that the continuous webs N face respective application ends of the tubular segments 21.

The machine 10 also comprises a pair of applicators 14 acting on respective continuous webs N to make and apply respective successions of closing elements 22 on respective application ends of successive tubular segments 21.

In one particular embodiment of this invention, the conveyor 11 is configured to convey a succession of double-length tubular segments 21 of the tobacco industry transversely along a conveying direction.

The term "double length tubular segment 21" is used to denote a tubular segment 21 whose length is such that it can be divided into two distinct parts of equal length to make two respective single-length tubular segments 21 of a smoking article 30.

According to this particular embodiment, the pair of applicators 14 makes closing elements 22 which are applied to respective opposite ends of each double-length tubular segment 21.

The machine 10 also comprises cutting means, disposed upstream or downstream of the pair of applicators 14 and configured to cut the double-length tubular segment 21 along a midplane so as to make a succession of pairs of tubular segments 21.

Advantageously, this invention achieves the preset aims and overcomes the disadvantages of the prior art by providing the user with a machine for making sub-units 20 of smoking articles which allows making a succession of sub-units 20 which are each provided with a closing wall adapted to hold the filling material within the smoking article 30, in particular after the finished product has been assembled.

Also an object of this invention is a method for making a sub-unit 20 of a smoking article 30 according to the embodiment of FIGS. 1-5 and preferably implemented by the machine of FIG. 1.

The method comprises a step of preparing a tubular segment 21 of the tobacco industry, specifically a tubular segment 21 internally provided with a through duct that terminates with end openings of the tubular segment 21. The tubular segment 21 forms part of a succession of tubular segments 21 advancing transversally to their axes of predominant extension.

The method comprises a step of applying a closing element 22 externally on at least one application end of the tubular segment 21 by means of a movable applicator 14 in such a way as to form a closing wall to at least partly close the application end.

More specifically, the applicator 14 moves with translational to-and-fro motion along an application direction parallel to the axis of predominant extension of the tubular segment 21.

The closing element 22 is made from a continuous web N which is fed and made available for processing, for example by unwinding it from a suitable roll.

More, specifically, applying the closing element 22 is accomplished by conveying a continuous web N along a working direction transverse to an axis of predominant extension of the tubular segments 21 and in such a way that the continuous web N faces respective application ends of the tubular segments 21.

The continuous web N is then punched, specifically by means of the movable applicator 14, in such a way as to separate a succession of closing elements 22 from it.

Lastly, the succession of closing elements 22 are placed against respective application ends in such a way as to form closing walls to at least partly close the application ends.

Thus, the continuous web N, after being engaged and punched by the applicator 14, has a succession of holes in it, corresponding to the closing elements 22 that have been separated from it.

Preferably, the method also comprises a step of applying an adhesive substance on the application end of the tubular segment 21 and/or on the closing element 22 according to a specific, predetermined pattern.

Similarly to what has already been described with regard to the operation of the gumming device of the machine 10, the predetermined pattern is preferably a pattern that follows as closely as possible the shape of the contact surface between the closing element 22 and the application end, so that only the parts of them that must actually be placed in contact with each other have an adhesive layer on them.

To guarantee the correct flow of air through the closing wall, the method comprises a step of increasing the air and/or gas permeability of the closing wall, preferably by making a plurality of holes or perforations in the continuous web N before cutting it.

The step of improving the permeability of the closing wall is carried out in particular if the material the closing element 22 is made of is impermeable to gases but it may also be carried out if the closing element 22 is made using a naturally porous material.

According to a specific aspect of the invention, the step of applying the closing element 22 is carried out by applying a pair of closing elements 22 simultaneously on each application end of the tubular segments 21. In this situation, the tubular segment 21 is double length and the method comprises a step of subsequently cutting the double-length tubular segment 21 along its midplane so as to obtain two tubular segments 21 of the tobacco industry.

The step of cutting may be performed before or after the step of applying the closing element 22.

The step of cutting is performed in such a way that the tubular segments 21 have first ends which are abutted against each other at the midplane of the double-length tubular segment 21 from which they originated, and second ends that are opposite to the first ends.

Preferably, the step of applying the closing element 22 is carried out by applying a pair of closing elements 22 simultaneously on opposite application ends of the tubular segments 21 of the pair of tubular segments 21—that is to say, by cutting a double-length tubular segment 21 into two distinct parts.

Advantageously, this invention achieves the preset aims and overcomes the disadvantages of the prior art by providing the user with a method for making a sub-unit 20 of a smoking article 30 which can guarantee the structural integrity of the finished product in which the sub-unit 20 thus made will be included.

Also an object of this invention is a smoking article 30, specifically a smoking article 30 that comprises the sub-units 20 made using the machine and/or the method described above.

More specifically, the smoking article 30 comprises an aerosol generating segment 31, a filter segment 32 and a spacer tube.

The aerosol generating segment 31 is preferably a tubular segment 21 into which an aerosol generating material of the tobacco industry has been inserted.

The filter segment 32 is preferably a tubular segment 21 made of a material suitable for making a filter of the tobacco industry, or a tubular segment 21 filled with a material suitable for making a filter of the tobacco industry.

The spacer tube is preferably an empty tubular segment 21 which is interposed between the aerosol generating segment 31 and the filter segment 32 in order to keep them separate.

The spacer tube has an end that is at least partly closed with a closing element 22 applied on an application end of it, thereby at least partly closing that application end.

More specifically, the closing element 22 is interposed between the spacer tube and at least one between the aerosol generating segment 31 and the filter segment 32.

Preferably, the spacer tube is abutted directly against the aerosol generating segment 31 or against the filter segment 32.

Figure 9:
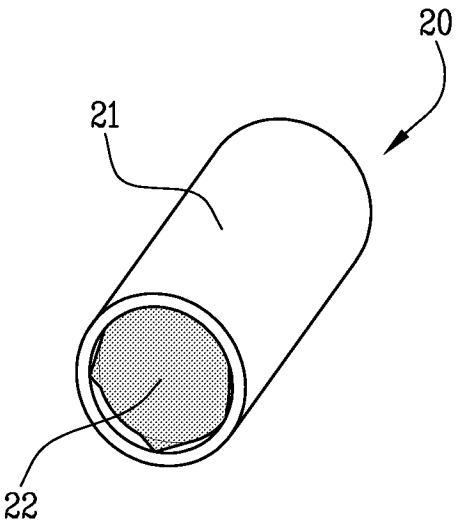
FIGS. 8 and 9 show the sub-units made by the machine of FIG. 6.

In one particular embodiment, shown in FIG. 9, the smoking article 30 comprises an additional segment 33 interposed between the spacer tube and the aerosol generating segment 31 or between the spacer tube and the filter segment 32.

The spacer tube is thus abutted directly against the additional segment 32, so that the closing element 22 is interposed directly between the spacer tube and the additional segment 33.

The additional segment 33 is preferably a tubular segment 21 filled with a cooling material of the tobacco industry.

Advantageously, the smoking article 30 described here achieves the preset aims, overcoming the disadvantages of the prior art in that the presence of the closing wall ensures that the aerosol generating element is retained correctly within the smoking article 30 and is prevented from escaping or being inhaled by the smoker.

Also an object of this invention is a method for making a smoking article 30 and comprising a step of preparing a filter segment 32, an aerosol generating segment 31 and a spacer tube, all three of which are made in accordance with what is described in the foregoing.

More specifically, the spacer tube has an end that is at least partly closed with a closing element 22 applied on an application end of it, thereby at least partly closing the application end.

The method also comprises a step of aligning the filter segment 32, the aerosol generating segment 31 and the spacer tube with each other along a direction of predominant extension in such a way that the closing element 22 is interposed between the spacer tube and the aerosol generating segment or between the spacer tube and the filter segment 32.

The method may also advantageously comprise a step of preparing an additional segment 33, specifically a cooling segment, preferably tubular.

During alignment of the elements to make up the smoking article 30, the additional segment 33 is interposed between the spacer tube and the aerosol generating segment or between the spacer tube and the filter segment 32.

More specifically, the additional segment 33 is applied by abutting it directly against the spacer tube, so that the closing element 22 is interposed directly between the spacer tube and the additional segment 33.

Advantageously, this invention achieves the preset aims and overcomes the disadvantages of the prior art by providing a method for making a sub-unit 20 of a smoking article 30 which can guarantee the structural integrity of the finished product in which the sub-units 20 thus made will be included.

FIGS. 6-10 show a machine 10 for making sub-units 20 of smoking articles according to a second embodiment of this invention.

In its more general aspects, the machine 10 according to the second embodiment is substantially similar or identical to the machine 10 according to the first embodiment.

Figure 6:
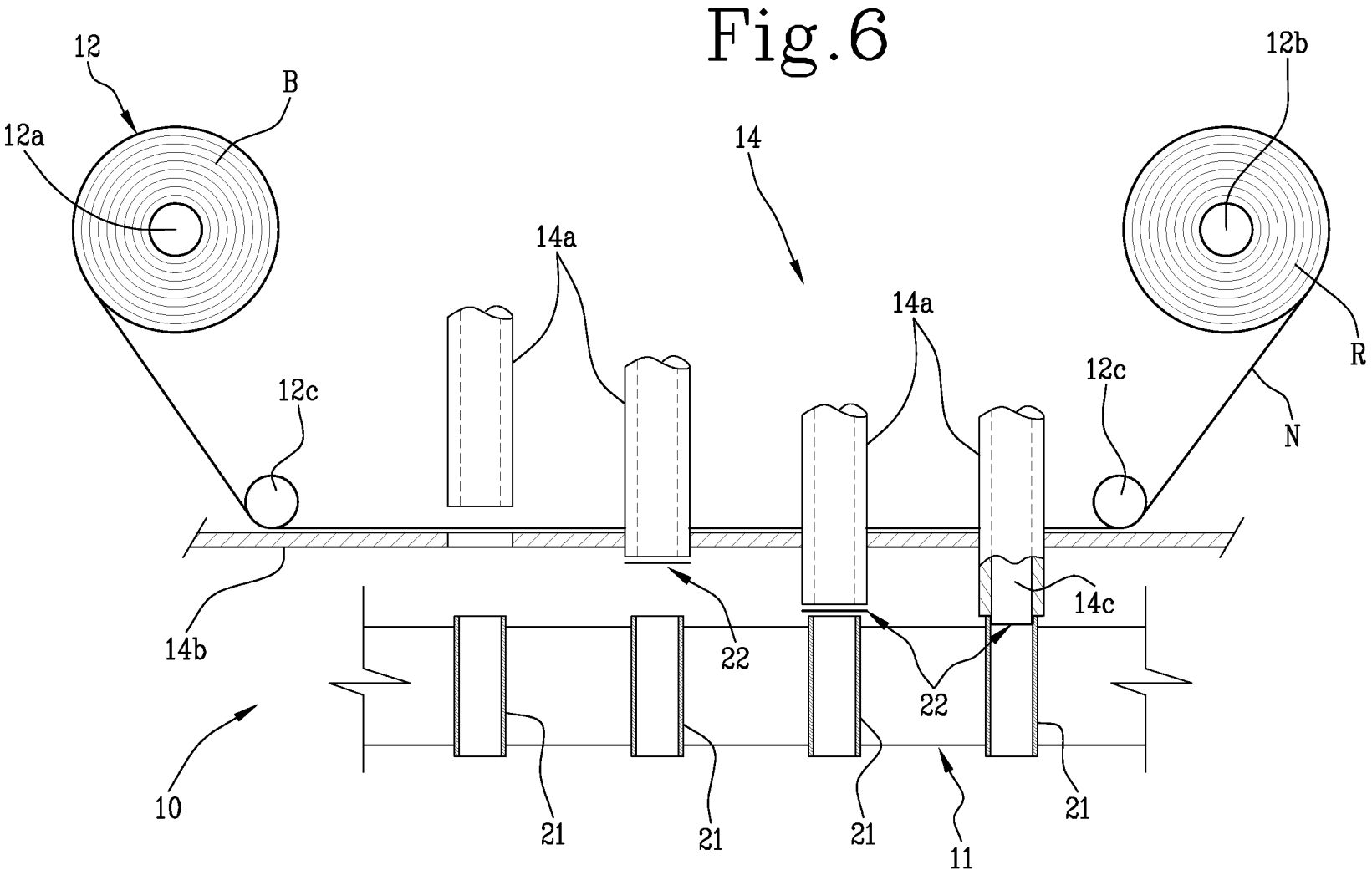
FIG. 6 schematically illustrates the main components of a machine according to a second embodiment of this invention.

For example, the machine 10 of FIG. 6 also comprises a conveyor 11, a feed unit 12, at least one applicator 14, wherein the conveyor 11 is configured to feed a succession of tubular segments of the tobacco industry and may be a conveyor drum, a conveyor belt or any other conveying device provided with suitable seats adapted to hold the tubular segments.

In the same way, the feed unit 12 is configured to feed the continuous web N along a feed direction parallel to the conveying direction of the tubular segments 21 so that the continuous web N faces respective application ends of the tubular segments 21. More specifically, the feed unit 12 comprises a first support 12*a* configured to support and unwind a roll B of continuous web N and a second support 12*b* configured to support and wind up a winding-up roll R round which the continuous web N can be wound.

In other words, the feed unit comprises suitable supports 12*a*, 12*b* which allow unwinding the continuous web N and feeding it to those parts of the machine 10 responsible for processing it and then collecting the portion of the continuous web N left unused by the processes and thus constituting waste that can be suitably disposed of or recycled.

The feed unit 12 also comprises guide means 12*c*—for example, fixed or movable rollers, either power-driven or idle—interposed between the first support 12*a* and the second support 12*b* and configured to convey and support the continuous web N along the feed direction, which is preferably rectilinear.

In the second embodiment, too, the applicator 14 is movable along an application direction parallel to an axis of predominant extension of each tubular segment 21 of the succession of tubular segments 21 and is configured to engage the continuous web N so as to separate at least one closing element 22 from it.

Unlike the previous embodiment, the applicator 14 is also configured to insert the closing element 22, which it has separated from the continuous web N, into an application end of a respective tubular segment 21 in such a way as to form a closing wall to at least partly close the application end.

In this case, too, however, the applicator 14 moves along the conveying direction synchronously with the conveyor 11 so as to remain facing a specific retaining seat of the conveyor, which is configured to receive and hold a tubular segment 21. Preferably, the synchronous movement is obtained by mounting the at least one applicator 14 on the conveyor 11 or on a different movement means advancing at the same speed as the conveyor 11.

In this embodiment, too, the machine 10 comprises a plurality of applicators 14, disposed in succession along the conveying direction and movable synchronously with the conveyor 11 along the conveying direction either because they are mounted on it or because they are provided with suitable movement means that allow the synchronized movement with the conveyor 11.

More specifically, the conveyor 11 and the at least one applicator 14 are movable along respective closed-loop trajectories running side by side, preferably having a pair of substantially rectilinear stretches parallel to the conveying direction.

In this case, too, the at least one applicator 14 is configured to separate from the continuous web N a succession of closing elements 22 having a circular or other shape, of diameter or size greater than or equal to the inside diameter of the tubular segments 21 into which they will be inserted.

More in detail, in the embodiment of FIG. 6, the applicator 14 comprises a punch 14*a*, a punch plate 14*c* and a pushing element 14*c*.

The punch 14*a* is configured to engage the continuous web N so as to separate respective closing elements 22 from it.

The punch plate 14*b*, on the other hand, is provided with a through hole that is shaped to match the punch 14*a* in such a way that the punch 14*a* can be inserted snugly into it.

The continuous web N is made to advance between the punch 14*a* and the punch plate 14*b* so that the punch sequentially engages first the continuous web N and, only after that, the hole in the punch plate 14*b*, so as to promote detachment of the closing element 22 from the continuous web N.

More specifically, the punch 14*a* has a substantially tubular body whose ends have preferably sharp edges adapted to engage the continuous web N to make the closing elements 22.

The pushing element 14*c*, on the other hand, is slidable inside the punch 14*a* and preferably has a substantially cylindrical body.

The pushing element 14*c* is configured to be inserted into the tubular segment 21 in such a way as to facilitate detaching the closing element 22 from the punch 14*a* and inserting the closing element 22 into the application end of the respective tubular segment Operatively, the punch 14*a* and the pushing element 14*c* move as one along a first stroke in which both of them engage the continuous web N, causing a closing element 22, whose profile matches the edge of the punch 14*a*, to be detached from the continuous web.

The first stroke ends when the punch 14*a* and the pushing element 14*c* are in proximity to, preferably in contact with, the application end.

At this point, the punch 14*a* stops, while the pushing element 14*c* continues moving along a second stroke which is, in practice, an extension of the first stroke, so it is partly inserted into the application end, carrying with it the closing element 22, which thus comes away from the punch 14*a* and is inserted into the application end.

Similarly to the embodiment of FIG. 1, the applicator 14 comprises a drive rod on which the punch 14*a* is applied and which is slidably inserted in a respective linear guide and engaged with a fixed cam. That way, as the applicator 14 advances along the conveying direction, the interaction between the drive rod and the fixed cam causes a to-and-fro translational movement of the drive rod along the application direction.

Figure 8:
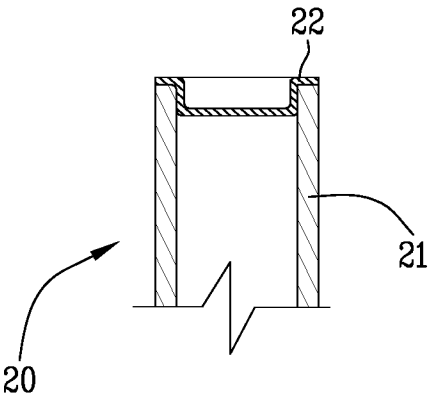
Figure 7:
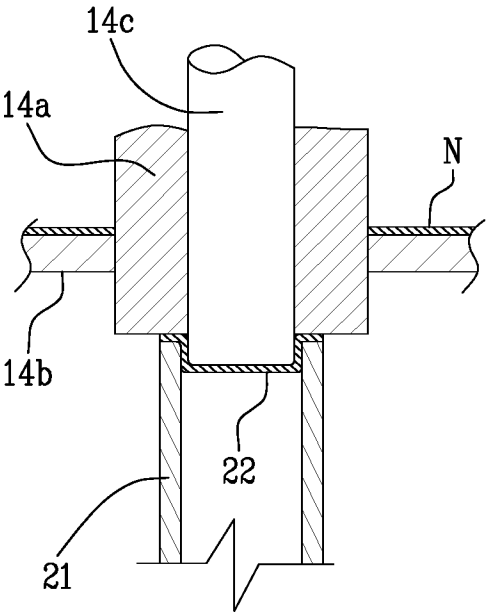
FIG. 7 shows in detail how a closing element is applied on the respective tubular segment by the machine of FIG. 6.

The closing wall thus made, illustrated in FIGS. 8 and 9, provides a barrier which, in this case, too, prevents any filling material of the smoking article 30 into which the sub-unit 20 will be placed from passing through the application end of the tubular segment 21.

At the same time, the closing wall allows the passage of air and/or gas and/or aerosol through the end of the sub-unit 20, in particular in the direction of a smoker during use of the smoking article 30 into which the sub-unit 20 has been inserted.

In a first possible embodiment, the closing element 22 has an overall size such as to completely cover the duct in the application end.

Alternatively, the closing element 22 has an overall size such as to only partly cover the duct in the application end.

If the closing wall completely covers the duct in the application end of the tubular segment 21, the closing element 22 is made of a porous material and/or has a plurality of holes or perforations for increasing the air or gas permeability of the closing wall in order to ensure a correct flow of air and/or gas and/or aerosol through the sub-unit 20.

In other words, if the closing wall is such as to completely close off access to the duct defined by the interior of the tubular segment 21, the closing element is made in such a way that air and/or gas and/or aerosol can in any case pass through because it is made of porous material and/or because it is provided with suitable openings.

For this purpose, this embodiment of the machine 10 also comprises perforating means which operate specifically on the continuous web N to make holes or perforations configured to allow air or gas to pass through and which preferably comprise at least one laser.

On the other hand, in the case where the closing wall is such as to only partly cover the duct in the application end of the tubular segment 21, the correct flow of air and/or gas and/or aerosol through the sub-unit 20 is guaranteed by those portions of the duct that remain uncovered and thus, the closing element 22 may also be made of a material that is impermeable to air.

It is, however, also possible for the closing element 22 to be made of porous material and or to be provided with a plurality of holes or perforations to increase the air or gas permeability of the closing wall even if the closing element 22 only partly closes the application end. More specifically, the closing element 22 may be made of metallic material: for example, aluminium.

Preferably, the closing element 22 is, in this case, too, made of flame retardant material.

Preferably, the closing element 22 is coupled to the respective tubular segment 21 by an interference fit: that is to say, inserted by pressure and held in place by friction exerted between a peripheral portion or peripheral portions of the closing element 22 and the inside wall of the tubular segment 21.

In addition and/or alternatively, the closing element 22 is coupled to the respective tubular segment 21 by gluing.

Under these circumstances, the machine 10 comprises a gumming device for applying an adhesive substance on the application end of the tubular segment 21 and/or on the closing element 22. In other words, the gumming device is operatively associated either with the conveyor 11 or with the feed unit 12 to apply, either on the inside surface of the application end or on the continuous web N, respectively, an adhesive substance that will subsequently allow the closing element 22 and the tubular segment 21 to be glued to each other at the application end.

Preferably, the gumming device is configured to apply the adhesive substance solely on the portion of the closing element 22 or of the tubular segment 21 that is intended to come into contact with the application end or with the closing element 22, respectively.

In other words, the adhesive layer is applied according to a pattern that follows the profile of the closing element 22 that is superposed on the inside surface of the application end of the tubular segment 21 and leaves free the part of the closing element 22 that directly faces the duct defined by the tubular segment 21. For example, the pattern may define gluing zones at the peripheral portion or peripheral portions of the closing element 22 which are folded back by approximately 90° relative to the central portion of the closing element 22 and which thus face the inside surface of the application end.

The machine 10 may further comprise detecting means configured to check the position of the closing element 22 relative to the application end.

The machine 10 may still further comprise the above mentioned folding means, disposed downstream of the at least one applicator 14.

Furthermore, the machine 10 may also comprise a pair of feed units 12 configured for feeding respective continuous webs N along feed directions parallel to the conveying direction of the tubular segments 21 and in such a way that the continuous webs N face respective applications ends of the tubular segments 21, specifically double-length tubular segments 21 of the tobacco industry, in the same way as described above. In this situation, also provided are cutting means configured to cut the double-length tubular segment 21 along a midplane so as to make a succession of pairs of tubular segments 21.

Advantageously, this invention achieves the preset aims and overcomes the disadvantages of the prior art by providing the user with a machine for making sub-units 20 of smoking articles which allows making a succession of sub-units 20 which are each provided with a closing wall adapted to hold the filling material within the smoking article 30, in particular after the finished product has been assembled.

Also an object of this invention is a method for making a sub-unit 20 of a smoking article 30 according to the embodiment of FIGS. 6-10 and preferably implemented by the machine of FIG. 6.

Similarly to the previous embodiment, the method comprises a step of preparing a tubular segment 21 of the tobacco industry, specifically a tubular segment 21 internally provided with a through duct that terminates with end openings of the tubular segment 21. The tubular segment 21 forms part of a succession of tubular segments 21 advancing transversally to their axes of predominant extension.

The method also comprises a step of applying a closing element 22 internally on at least one application end of the tubular segment 21 by means of a movable applicator 14 in such a way as to form a closing wall to at least partly close the application end.

The applicator 14 moves with translational to-and-fro motion along an application direction parallel to the axis of predominant extension of the tubular segment 21.

The closing element 22 is made from a continuous web N which is fed and made available for processing, for example by unwinding it from a suitable roll.

Applying the closing element 22 is accomplished by conveying the continuous web N along a working direction transverse to an axis of predominant extension of the tubular segments 21 and in such a way that the continuous web N faces respective application ends of the tubular segments 21.

The continuous web N is then punched, specifically by means of the movable applicator 14, and still more specifically, by means of the punch 14*a*, in such a way as to separate a succession of closing elements 22 from it.

Lastly, the succession of closing elements 22 are inserted into respective application ends, specifically by the pushing element 14*c*, in such a way as to form closing walls to at least partly close the application ends. During insertion, one or more peripheral portions of the closing element 22 are preferably folded back in such a way as to lock the closing element in place by interference.

Alternatively or in addition to this deformation during insertion, the method also comprises a step of applying an adhesive substance on the application end of the tubular segment 21 and/or on the closing element 22 according to a specific, predetermined pattern.

Similarly to what has already been described with regard to the operation of the gumming device of the machine 10, the predetermined pattern is preferably a pattern that follows as closely as possible the shape of the contact surface between the closing element 22 and the application end, so that only the parts of them that must actually be placed in contact with each other have an adhesive layer on them.

To guarantee the correct flow of air through the closing wall, the method comprises a step of increasing the air and/or gas permeability of the closing wall, preferably by making a plurality of holes or perforations in the continuous web N before cutting it.

The step of improving the permeability of the closing wall is carried out in particular if the material the closing element 22 is made of is impermeable to gases but it may also be carried out if the closing element 22 is made using a naturally porous material.

According to a specific aspect of the invention, the step of applying the closing element 22 is carried out by applying a pair of closing elements 22 simultaneously on opposite application ends of the tubular segments 21, where the tubular segments 21 are double-length segments. In this situation, the method also comprises a step of cutting the double-length tubular segment 21 along its midplane so as to obtain two tubular segments 21 of the tobacco industry, each of which is provided, at an application end of it, with a closing element 22 inserted therein.

The step of cutting may be performed before or after the step of inserting the closing element 22.

Advantageously, this invention achieves the preset aims and overcomes the disadvantages of the prior art by providing the user with a method for making a sub-unit 20 of a smoking article 30 which can guarantee the structural integrity of the finished product in which the sub-unit 20 thus made will be included.

Also an object of this invention is a smoking article 30, specifically a smoking article 30 that comprises one or more sub-units 20 made using the machine and/or the method described above.

Figure 5:
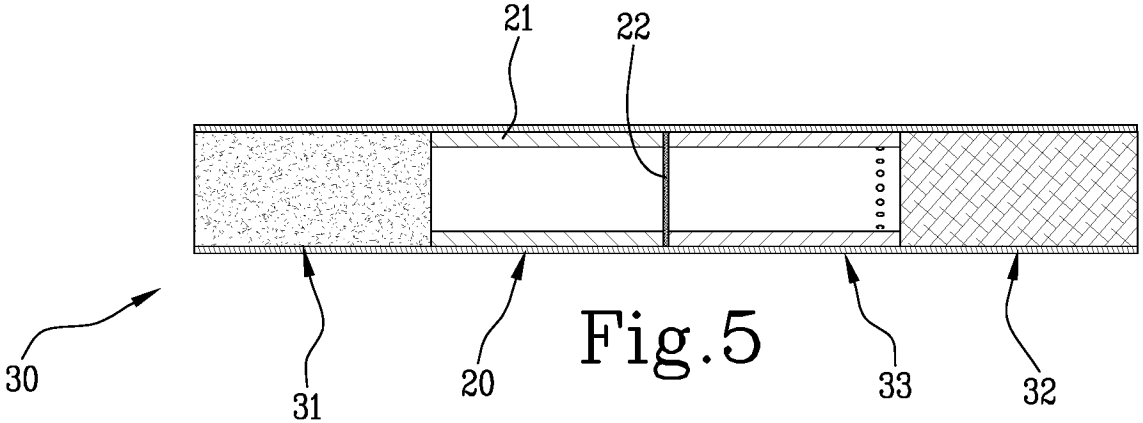
FIG. 5 shows a cross section of a smoking article made using the machine of FIG. 1.
Figure 10:
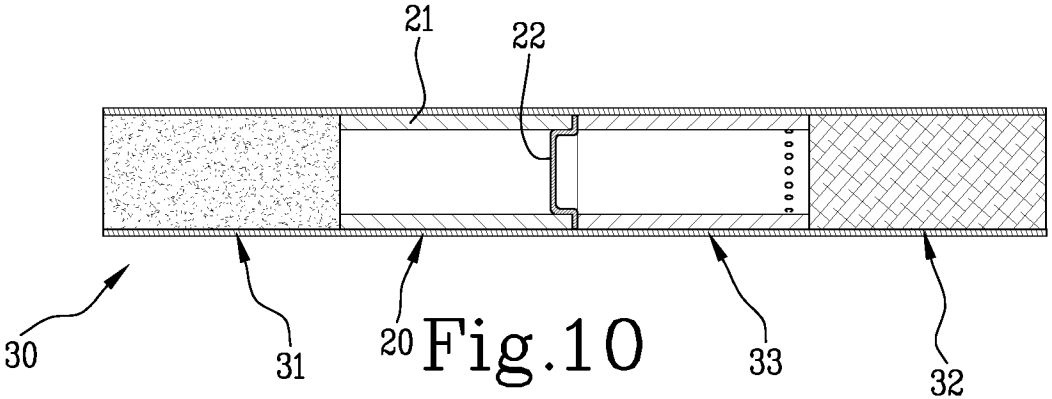
FIG. 10 shows a cross section of a smoking article made using the machine of FIG. 6.

As shown in FIGS. 5 and 10, the smoking article 30 comprises an aerosol generating segment 31, a filter segment 32 and a spacer tube.

The aerosol generating segment 31 is preferably a tubular segment 21 into which an aerosol generating material of the tobacco industry has been inserted.

The filter segment 32 is preferably a tubular segment 21 made of a material suitable for making a filter of the tobacco industry, or a tubular segment 21 filled with a material suitable for making a filter of the tobacco industry.

The spacer tube is preferably an empty tubular segment 21 which is interposed between the aerosol generating segment 31 and the filter segment 32 in order to keep them separate.

The spacer tube has an end that is at least partly closed with a closing element 22 applied on an application end of it, thereby at least partly closing that application end.

More specifically, the closing element 22 is interposed between the spacer tube and at least one between the aerosol generating segment 31 and the filter segment 32.

Preferably, the spacer tube is abutted directly against the aerosol generating segment 31 or against the filter segment 32.

In the embodiment illustrated in FIGS. 5 and 10, the smoking article 30 comprises an additional segment 33 interposed between the spacer tube and the aerosol generating segment 31 or between the spacer tube and the filter segment 32.

The spacer tube is thus abutted directly against the additional segment 33, so that the closing element 22 is interposed directly between the spacer tube and the additional segment 33.

The additional segment 33 is preferably a tubular segment 21 filled with a cooling material of the tobacco industry.

In the embodiment of FIG. 5, where the closing element 22 is applied externally on an application end of the tubular segment 21, the closing element 22 lies in a plane corresponding to the positioning plane of the application end (which coincides, in FIG. 5, with the plane of juxtaposition between the tubular segment 21 and the additional segment 33.

In the embodiment of FIG. 10, where the closing element 22 is inserted into an application end of the tubular segment 21, the closing element 22 is shaped or deformed in such a way as to form a convex surface (or recess) facing towards the aerosol generating segment 31, since the recess is created by the pushing movement applied by the pushing element 14*c*.

In other words, the closing element 22 is shaped in a way that is particularly suitable for resisting deformation or detachment from the tubular segment 21 in which it is inserted, particularly when it is subjected to thrust from the direction where the aerosol generating segment 31 is located.

In the specific embodiment of FIG. 10, the closing element 22 has a central portion (for example, flat), positioned to close the tubular segment 21, and a coupling portion that is folded relative to the central portion and defining an interference fit connecting it to the inside wall of the application end. The closing element 22 may also have one or more edge portions which are interposed between the tubular segment and the additional segment 33 and which are, in particular, held between them.

Alternatively, according to a further possible embodiment, the coupling portion of the closing element 22 is coupled to the tubular segment 21 by gluing.

Also an object of this invention is a method for making a smoking article 30 and comprising a step of preparing a filter segment 32, an aerosol generating segment 31 and a spacer tube, all three of which are made in accordance with what is described in the foregoing.

More specifically, the spacer tube has an end that is at least partly closed with a closing element 22 applied externally (FIGS. 1-5) or internally (FIGS. 6-10) on an application end of it, thereby at least partly closing the application end.

The method also comprises a step of aligning the filter segment 32, the aerosol generating segment 31 and the spacer tube with each other along a direction of predominant extension in such a way that the closing element 22 is interposed between the spacer tube and the aerosol generating segment or between the spacer tube and the filter segment 32.

The method may also advantageously comprise a step of preparing an additional segment 32, specifically a cooling segment, preferably tubular.

During alignment of the elements to make up the smoking article 30, the additional segment 33 is interposed between the spacer tube and the aerosol generating segment or between the spacer tube and the filter segment 32.

More specifically, the additional segment 33 is applied by abutting it directly against the spacer tube, so that the closing element 22 is interposed directly between the spacer tube and the additional segment 33 (FIG. 5) or positioned inside the spacer tube in proximity to or at the additional segment 33.

Advantageously, the method described here allows making a smoking article 30 that is particularly resistant and of high quality and capable of ensuring that the filling material inside it is held properly within (and thus serves it purpose).

The invention claimed is:

1. A method for making a sub-unit of a smoking article, comprising the steps of:

preparing a tubular segment of the tobacco industry, the tubular segment being internally provided with a through duct terminating with end openings of the tubular segment;

applying a closing element internally or externally on an application end of the tubular segment to form a closing wall to at least partly close the application end;

performing the step of applying the closing element with an applicator moving with translational to-and-fro motion along an application direction parallel to an axis of predominant extension of the tubular segments of the succession of tubular segments.

2. The method according to claim 1, wherein the step of applying the closing element comprises the sub-steps of:

conveying a continuous web along a working direction transverse to the axis of predominant extension such that the continuous web faces respective application ends of the tubular segments;

punching the continuous web with the applicator to cut the closing element out of the continuous web;

placing the closing element externally against the application end to form the closing wall to at least partly close the application end.

3. The method according to claim 1, wherein the step of applying the closing element comprises the sub-steps of:

conveying a continuous web along a working direction transverse to the axis of predominant extension such that the continuous web faces respective application ends of the tubular segments;

punching the continuous web with the applicator to cut the closing element out of the continuous web;

inserting the closing element into the application end to form the closing wall to at least partly close the application end.

4. The method according to claim 1, and further comprising a step of applying an adhesive substance on the application end of the tubular segment and/or on the closing element.

5. The method according to claim 1, and further comprising a step of increasing an air and/or gas permeability of the closing element.

6. The method according to claim 1, wherein the step of applying the closing element is carried out by simultaneously applying a pair of the closing elements internally or externally on opposite application ends of the tubular segments.

7. The method according to claim 1, wherein the step of preparing the tubular segment comprises preparing a double length tubular segment; the method further comprising a step of cutting the double length tubular segment along a midplane thereof to obtain two tubular segments of the tobacco industry having first ends abutted against each other at the midplane and second ends opposite the first ends.

8. The method according to claim 7, wherein the step of applying the closing element is carried out by simultaneously applying a pair of the closing elements internally or externally on opposite application ends of the tubular segments of the pair of tubular segments, the application ends being defined by the second ends.

9. The method according to claim 5, and further comprising performing the step of increasing the air and/or gas permeability of the closing element by making a plurality of holes or perforations in the continuous web before the continuous web is punched to cut the closing element out of the continuous web.

* * * * *